United States Patent [19]

Eichler

[11] 4,125,083

[45] Nov. 14, 1978

[54] DRIVE FOR SUBMERGED FLOATING BODIES

[76] Inventor: Horst Eichler, Auf den Sande 12, 5400 Koblenz, Fed. Rep. of Germany

[21] Appl. No.: 703,775

[22] Filed: Jul. 9, 1976

Related U.S. Application Data

[63] Continuation of Ser. No. 473,537, May 28, 1974, abandoned.

[30] Foreign Application Priority Data

Jun. 16, 1973 [DE] Fed. Rep. of Germany ..... 2330860

[51] Int. Cl.[2] ..... B63H 11/02

[52] U.S. Cl. ..... 115/14; 60/221; 115/12 R

[58] Field of Search ..... 115/11, 12 R, 12 A, 115/14, 15, 42, 31, 32, 33, 28 A; 114/151, 166; 60/221

[56] References Cited

U.S. PATENT DOCUMENTS

| | | | |
|---|---|---|---|
| 3,062,002 | 11/1962 | Shaffer | 60/221 X |
| 3,066,893 | 12/1962 | Mercier | 115/42 X |
| 3,209,719 | 10/1965 | Christopher | 115/28 A |
| 3,557,736 | 1/1971 | Baer | 114/151 |
| 3,605,672 | 9/1971 | Strumbos | 114/166 |

FOREIGN PATENT DOCUMENTS

| | | | |
|---|---|---|---|
| 1,210,330 | 2/1966 | Fed. Rep. of Germany | 115/28 A |
| 1,364,274 | 12/1964 | France | 115/14 |
| 751,591 | 6/1956 | United Kingdom | 115/28 A |

*Primary Examiner*—Trygve M. Blix
*Assistant Examiner*—Sherman D. Basinger
*Attorney, Agent, or Firm*—Beall & Jeffery

[57] ABSTRACT

A drive for submerged portions of floating bodies, i.e. watercraft comprising a pulsating nozzle including a control device for pulsating the nozzle by expansion and contraction of an open inner nozzle diameter portion. The control device contracts and expands the nozzle such that during expansion the front of the nozzle is expanded to a greater extent than the rear of the nozzle to produce a positive angle of attack, and during contraction the rear of the nozzle remains expanded to a greater extent than the front of the nozzle to produce a negative angle of attack.

10 Claims, 3 Drawing Figures

DRIVE FOR SUBMERGED FLOATING BODIES

This is a continuation of application Ser. No. 473,537, filed May 28, 1974 now abandoned.

This invention relates to a drive for submerged portions of floating bodies that is, watercraft. A known drive for floating bodies of this type is the Ressel ship propeller. However, this propeller has certain disadvantages, because a relatively small amount of water causes a fast acceleration. Thus, a relatively large loss of energy occurs due to turbulence, noise, and loss of heat. In contrast, the drive of the present invention does not accelerate a large amount of water with the increased speed of the ship. Hence, the average speed of the flow of water is correspondingly lower, and the degree of propulsion effectiveness of the drive is larger, and the noise level is lower.

It is therefore an object of this invention to provide a drive for a floating body which has less loss of energy and a lower noise level. This object of the invention is obtained by a pulsating nozzle which serves as a drive for the floating body. With increasing speed, the jet casing assumes a larger quantity of water latrally with respect to the moving direction of the vessel. In a conventional device, the propeller drive is in the direction of travel of the vessel.

The invention consists of a pulsating nozzle which forms an annular resilient tube, whereby the alternating pulsation opens the inside nozzle diameter at a greater diameter in the front nozzle opening during the expansion, and the rear nozzle opening enlarges to a greater diameter during the contraction. The construction of the nozzle is preferably in form of a cylindrical body made of an elastic material, whereby mechanical, hydraulic and/or pneumatic means provide the pulsating opening and contracting effect of the inside diameter of the nozzle. The contracting effect is achieved due to the inherent elasticity of the material. The nozzle body is coaxially arranged around the cylindrically shaped floating body. The nozzle body may also be connected with a coaxially arranged rotating member. The connection of the nozzle body with the submerged body of rotation of the watercraft may be carried out by radial ribs which are made of elastic material and/or by moveable ribs which may be pivotable.

The expansion and contraction of the nozzle body, and the control of the blade angle may be done by cells provided in the front and rear portion of the nozzle body. The cells are in connection with means for expanding and contracting of the nozzle body by means of a pipe line system. The pulsating of the nozzle can be done with a constant or a variable amplitude (the amplitude being a measure of the difference between the fully contracted position of the nozzle and the fully expanded position of the nozzle) or cycle (which would be the repeat period of expanding and contracting of the nozzle) for opening or contracting the nozzle body, and may be coupled with constant or variable magnitudes of the blade angle (the angle of attack of the inner fluid reaction surface of the nozzle being the actual angle between the inner fluid reaction surface of the nozzle and a reference such as the drive direction) of the nozzle profile.

The constant or variable forward or rearward motion may be carried out by a digital or analog operating control device which is mounted either in the floating body, or in the submerged member.

In order to achieve an effective guidance of the hydraulic or pneumatic means for expanding and/or contracting the inside diameter of the nozzle body, the walls of the cells and the cross diameter of the pipes may be supported in such a way that they stay evenly large during the expansion and contraction operation. The novel nozzle can be used for a driving means as well as a steering control means. For this steering purpose, the nozzle body is formed in segments which can expand or shrink asymmetrically with respect to the axis of rotation.

Other objects and features of the present invention will become apparent from the following detailed description when taken in connection with the accompanying drawing which discloses a single embodiment of the invention. It is to be understood that the drawing is designed for the purpose of illustration only, and is not intended as a definition of the limits and scope of the invention.

In the drawing, wherein similar reference numerals denote similar elements throughout the several views.

Figure 1:
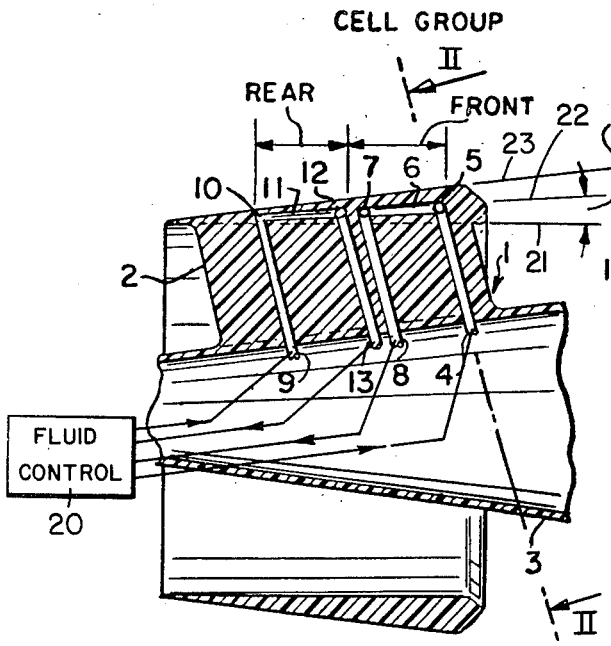
FIG. 1 shows a longitudinal section of a watercraft propulsion device embodying the features of the present invention.
Figure 2:
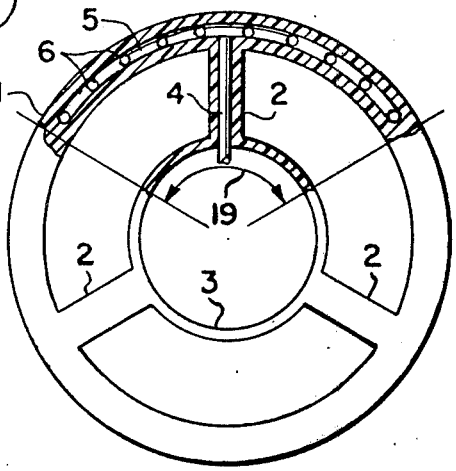
FIG. 2 is a partial cross sectional view of the nozzle taken along lines II—II of FIG. 1.

Referring to FIGS. 1 and 2, the drive essentially consists of a nozzle 1, which is mounted for radial expansion and contraction on a submerged solid body of rotation 3 of the watercraft by means of ribs 2. The nozzle 1 is provided with an elastic ring having therein a front group of expansible chamber cells 6 in an annular array and a rear group of expansible chamber cells 11 in an annular array, with each cell being adapted to be expanded by a pressurized fluid medium to correspondingly expand the diameter of the nozzle ring and radially stretch the elastic ribs 2. The shrinking of nozzle 1 is done due to the elasticity of the material, when the fluid pressure within the cells is relieved. Each rib 2 is made of an elastic material, which ribs 2 due to their inherent elasticity will bias the nozzle from its expanded position to its contracted position, having feed lines 4 and 9 and discharge lines 8 and 13 for respectively supplying and discharging a pressure medium to the forward group of cells 6 and the rearward group of cells 11. A control device 20 is provided for the supply and discharge of the pressure medium to the front and rear groups of cells 6 and 11.

The front cell groups 6 are hydraulically pressured together with the rear cell groups, while nozzle 1 expands coaxially. When the rear nozzle groups 11 are pressurized to a greater extent than the front cell groups 6, the nozzle 1 expands to the rear to a greater extent than the front so as to provide the nozzle ring with an angle of attack as shown at 21, which is a negative angle of attack with respect to the zero position angle of attack at 22 (negative blade angle of the nozzle profile). When the front group of cells 6 are pressurized to a greater extent than the rear group of cells 11, the nozzle 1 expands to the front to a greater extent than to the rear so as to assume an angle of attack as shown at 23 that is positive with respect to the zero position angle of attack at 22 (positive blade angle of the nozzle profile). As shown in FIG. 2, the three ribs 2 divide the nozzle into three substantially identical segments 19. When the front and rear cell groups 6 and 11 are differently pressured for the nozzle segments 19 through ribs 2, nozzle 1 deforms axially asymmetrically and acts as a control rudder, that is, due to nozzle 1, an actively acting rudder is obtained.

The arrows in FIG. 1 show a pressure medium forced through pipes 4 and 9 which are reinforced in cross section in order to prevent an expansion of the pipes. As a variation of the illustrated embodiment, the cells 6 and 11 may be provided in ribs 2, and peripheral pipe lines 5 and 10 in the different segments 19 of jet 1 can be expanded (enlarged), in order to provide an expansion of the profile. When the pressure medium is released from pipes 8 and 13 in ribs 2, and from pipes 7 and 12 of nozzle 1, cells 6 and 11 and nozzle 1 are contracted by the inherent elasticity of the material.

Figure 3:
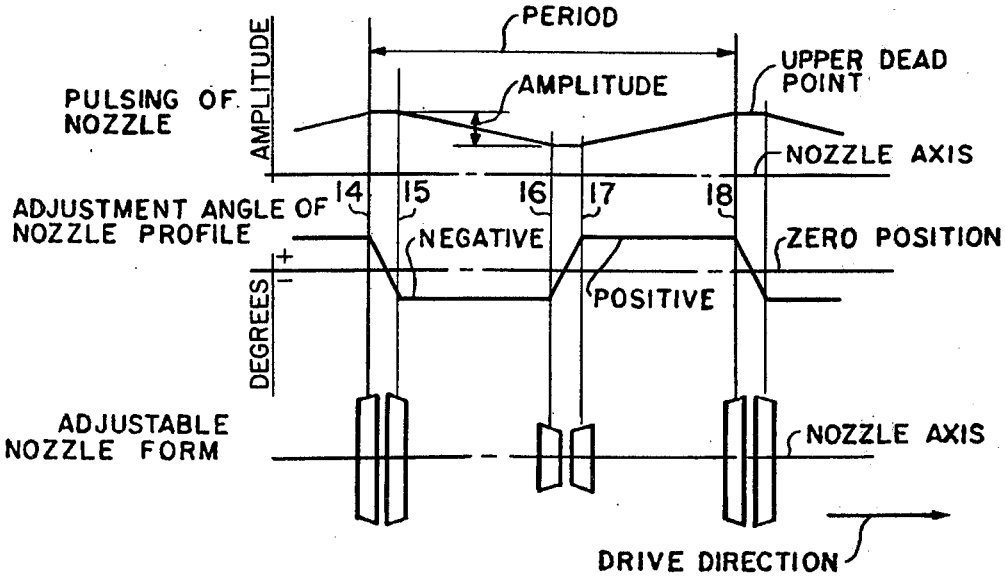
FIG. 3 shows the operational movement of the drive means.

FIG. 3 shows the drive operation of nozzle 1. The diagrams of FIG. 3 are arranged so that the top diagram is a plot of the bodily expansion and contraction of the nozzle ring as it moves through the water in the drive direction from the left to right, with the horizontal axis thus representing time, or distance traveled in the drive direction and the vertical axis representing the amplitude of such expansion and contraction; the middle diagram of FIG. 3 is a plot showing the adjustment angle of the nozzle profile, that is the angle of attack of the inner peripheral surface of the nozzle ring that reacts with the water to produce propulsion as it varies about a zero position towards the positive to represent angles of attack between lines 22 and 23 of FIG. 1 and negative to represent angles of attack between lines 22 and 21 of FIG. 1; and the lower diagram shows actual nozzle ring shapes or forms as they appear in the various positions along the drive direction in vertical alignment with the corresponding positions on the other two diagrams.

In the upper diagram of FIG. 3, at position 14 the nozzle is in its most expanded position, termed the upper dead point, which fully expanded state remains until position 15. Between positions 15 and 16, the nozzle is contracted for the full amplitude continuously to position 16 where it is fully contracted at its lower dead point, which fully contracted condition of the nozzle ring is retained from position 16 to position 17. From position 17 to position 18, the nozzle ring is bodily expanded continuously until it reaches its fully expanded condition at the upper dead point position 18. The bodily contraction and expansion of the nozzle ring between positions 14 and 18 represents one period of the cyclic movement, which period is repeated. It is thus seen that any point on the nozzle ring moves generally sinusoidally through the water as the watercraft is rectilinearly moved in the drive direction.

As shown in the middle diagram of FIG. 3, the inner water reaction surface of the nozzle ring is provided with a positive angle of attack at position 14, which would correspond to line 23 in FIG. 1; the nozzle form shown in the lower diagram of FIG. 3 for position 4 shows the nozzle fully expanded with a positive angle of attack. As explained above, such positive angle of attack is obtained by pressurizing and thus expanding the front group of cells 6 to a greater extent than the rear group of cells 11. In moving from position 14 to position 15, the angle of attack of the nozzle is changed from positive to negative which would correspond to line 21 of FIG. 1 so as to produce the fully expanded negative angle of attack nozzle form as shown in position 15 in the lower diagram of FIG. 3. As explained above, the negative angle of attack is obtained by pressurizing and thus expanding the rear group of cells 11 to a greater extent than the front group of cells 6. The negative angle of attack is maintained as the nozzle moves from position 15 to position 16 during contraction, and a propulsion in the drive direction will be produced. The fully contracted negative angle of attack shape of the nozzle form is shown in the lower diagram for position 16. In moving from 16 to position 17, the angle of attack is changed from negative to positive while the nozzle is fully contracted. In moving from position 17 to position 18, this positive angle of attack is maintained while the nozzle is expanded from its fully contracted position to its fully expanded position. It is seen, from the lower diagram of FIG. 3, that the fully expanded positive angle of attack shape of the nozzle in position 18 is the same as that in position 14, and as mentioned above one full period of the cyclic movement has been completed. With the angle of attack, expansion and contraction of the nozzle always being uniform around the entire periphery of the ring, rectilinear propulsion will be obtained in the drive direction that is generally coaxial with the nozzle axis.

As mentioned above, if the pressurization in the cell groups 6 and 11 is not uniform as between segments 19, a steering control function will be obtained. That is, with unequal pressurization in the segments 19, one segment may have a different angle of attack than an adjacent segment so as to produce more or less propulsion than the adjacent segment. It is thus seen that if the right segment is producing more propulsion than the left segment, the watercraft will tend to move towards the left.

While only a single embodiment of the present invention has been shown and described, it will be obvious to those skilled in the art that many changes and modifications may be made thereunto without departing from the spirit and scope of the invention.

What is claimed is:

1. A propulsion drive for a watercraft comprising: an enclosed nozzle for passing environmental water axially therethrough in the drive direction including a radially facing reaction surface means for controlling the flow of adjacent environmental water to be acted upon to gain propulsion reaction forces axially; said reaction surface means having a leading portion for receiving the environmental water and a trailing portion for discharging the environmental water;

control means for contracting and expanding said reaction surface means bodily toward and away from the axis between an outermost expanded position and an innermost contracted position;

said control means contracting said reaction surface means with a negative angle of attack with respect to a neutral position from said outermost expanded position to said innermost contracted position, and expanding said reaction surface means with a positive angle of attack from said innermost contracted position to said outermost expanded position, as the watercraft moves rectilinearly through the water for generating reaction forces along the axis.

2. The propulsion drive of claim 1, wherein said control means maintains the angle of attack of said reaction surface means substantially uniformly around the entire periphery of said nozzle for rectilinear drive and changes the angle of attack asymmetrically around the periphery of said nozzle for steering.

3. The propulsion drive of claim 2, wherein said reaction surface means comprises an annular resilient tube elastically expansible and contractible between said outermost expanded and innermost contracted positions.

4. The propulsion drive of claim 3, including a central rigid body of revolution concentrically spaced within said reaction surface means, and a plurality of radially extending elastic ribs connecting said central rigid body with said annular tube, so that the inherent elasticity of said ribs provides means biasing said annular tube from its outermost expanded position to its innermost contracted position.

5. The propulsion drive of claim 4, including a plurality of front expansible chamber fluid cells within and peripherally spaced around said annular tube adjacent the leading portion, and a plurality of separate independent rear expansible chamber fluid cells within and peripherally spaced around said annular tube adjacent the trailing portion; and said control means supplying pressurized fluid to said front cells and independently to said rear cells so that pressurization of said front cells to a greater extent than said rear cells will provide a positive angle of attack and pressurization of said rear cells to a greater extent than said front cells will provide a negative angle of attack.

6. The propulsion drive of claim 3, including a plurality of front expansible chamber fluid cells within and peripherally spaced around said annular tube adjacent the leading portion, and a plurality of separate independent rear expansible chamber fluid cells within and peripherally spaced around said annular tube adjacent the trailing portion; and said control means supplying pressurized fluid to said front cells and independently to said rear cells so that pressurization of said front cells to a greater extent than said rear cells will provide a positive angle of attack and pressurization of said rear cells to a greater extent than said front cells will provide a negative angle of attack.

7. The propulsion drive of claim 1, wherein said reaction surface means comprises an annular resilient tube elastically expansible and contractible between said outermost expanded and innermost contracted positions.

8. The propulsion drive of claim 7, including a central rigid body of revolution concentrically spaced within said reaction surface means, and a plurality of radially extending elastic ribs connecting said central rigid body with said annular tube, so that the inherent elasticity of said ribs provides means biasing said annular tube from its outermost expanded position to its innermost contracted position.

9. The propulsion drive of claim 8, including a plurality of front expansible chamber fluid cells within and peripherally spaced around said annular tube adjacent the leading portion, and a plurality of separate independent rear expansible chamber fluid cells within and peripherally spaced around said annular tube adjacent the trailing portion; and said control means supplying pressurized fluid to said front cells and independently to said rear cells so that pressurization of said front cells to a greater extent than said rear cells will provide a positive angle of attack and pressurization of said rear cells to a greater extent than said front cells will provide a negative angle of attack.

10. The propulsion drive of claim 7, including a plurality of front expansible chamber fluid cells within and peripherally spaced around said annular tube adjacent the leading portion, and a plurality of separate independent rear expansible chamber fluid cells within and periphrally spaced around said annular tube adjacent the trailing portion; and said control means supplying pressurized fluid to said front cells and independently to said rear cells so that pressurization of said front cells to a greater extent than said rear cells will provide a positive angle of attack and pressurization of said rear cells to a greater extent than said front cells will provide a negative angle of attack.

* * * * *